United States Patent [19]

Feess et al.

[11] 4,094,637

[45] June 13, 1978

[54] PROCESS FOR THE PRINTING WITH DEVELOPING DYES

[75] Inventors: Erich Feess, Hofheim, Taunus; Willy Gronen, Kelkheim, Taunus; Hasso Hertel, Muhlheim (Main), all of Germany

[73] Assignee: Hoechst Aktiengesellschaft, Frankfurt am Main, Germany

[21] Appl. No.: 623,338

[22] Filed: Oct. 17, 1975

[30] Foreign Application Priority Data

Oct. 19, 1974 Germany ..... 2449782
Mar. 17, 1975 Germany ..... 2511537

[51] Int. Cl.[2] ..... C09B 27/00; D06P 1/02

[52] U.S. Cl. ..... 8/71; 8/27; 8/44; 8/46; 8/54.2; 8/68; 8/70

[58] Field of Search ..... 8/71, 44, 46, 27, 70

[56] References Cited

U.S. PATENT DOCUMENTS

| | | | |
|---|---|---|---|
| 2,349,561 | 5/1944 | Reynolds et al. | 8/71 |
| 3,000,298 | 9/1961 | Bryant et al. | 8/46 |
| 3,288,552 | 11/1966 | Streck | 8/44 |
| 3,436,168 | 4/1969 | Streck | 8/45 |
| 3,494,716 | 2/1970 | Hoffman | 8/21 |
| 3,516,780 | 6/1970 | Kirst et al. | 8/44 |
| 3,787,179 | 1/1974 | Lowenfeld | 8/45 |
| 3,920,386 | 11/1975 | Beyer et al. | 8/21 C |
| 3,961,886 | 6/1976 | Hertel et al. | 8/44 |

FOREIGN PATENT DOCUMENTS 525,099 8/1940 United Kingdom.

*Primary Examiner*—A. Lionel Clingman
*Attorney, Agent, or Firm*—Curtis, Morris & Safford

[57] ABSTRACT

Cellulosic material is printed with a paste containing the alkaline solution of a coupler, the dispersion of a diazotable aromatic amine, a nitrite and a thickener and the dyestuff is developed on the fiber by acidic steaming or by adding solutions of organic acids and steaming or drying.

10 Claims, No Drawings

PROCESS FOR THE PRINTING WITH DEVELOPING DYES

The present invention relates to a process for printing cellulosic material with developing dyes.

Developing dyes are eagerly used for the textile printing owing to their high tinctorial strength, their good fastness properties and their economy.

They are generally employed by first impregnating a fabric with an alkaline solution of a passively coupling component and, after drying, printing the fabric with a printing paste that contains an aryl diazonium salt. Areas that have been impregnated but not printed are washed clear of the coupling component during the aftertreatment.

A drawback of this working method is the impregnation of the fabric which means a particular operation step. The low stability of some diazonium salts in the printing pastes may cause tailing on the fabric. Since unprinted portions of the fabric are also impregnated with the coupling component, the economy of the process dwindles away with a decreasing cover, which means that the said process is not suitable for articles with a high white ground portion.

To avoid these drawbacks, anti-diazotates and diazo amino compounds may be used as diazo components. These do not react with the coupling components in an alkaline medium, and in an acid medium — or partly in a neutral medium at an elevated temperature — they are converted into the diazonium salt capable of coupling on the coupling component present, to yield an azo dyestuff. In this stabilized form, they may be applied together with the coupling component in an alkaline printing paste onto the untreated fabric. Dyestuff formation is brought about by subsequent acidic or neutral steaming. Certainly, the preparation of these compounds is rather expensive, and the costs for the prints are accordingly high.

In contrast thereto, the methods disclosed in German Pat. Nos. 638,878; 644,070; 661,496; and 729,846 use the precursors of all diazo compounds, i.e. the free amines. To this effect, a mixture of amines that should be neither liquid nor low-melting nor readily volatile, of alkali metal salts of coupling components, and of sodium nitrite is applied onto the fiber, and diazotization is performed by means of an acid passage at normal temperature. Azo coupling is then caused by passing the material through an acid-binding medium, slowly drying it, carefully rinsing it or storing it, optionally in ammonia vapors. The necessary two-fold aftertreatment renders the process complicated and uneconomical despite the saving in cost due to the use of free amines. Moreover, the prints obtained may vary greatly if the period of action of the acidic and alkaline liquors is differently long.

It has now been found that prints can be produced with developing dyes on cellulosic textile material in a simple manner and at low cost by printing the untreated material with a printing paste containing a. an alkaline solution of a coupling component suitable for the printing with developing dyes,
b. a dispersion of an amine suitable for the preparation of developing dyes,
c. sodium nitrite, and
d. a printing thickener, and developing the dyestuff on the fiber either by acidic steaming or by applying a dilute aqueous solution of an organic acid having a minimum solubility in water of 30 g per 100 g of water, a pK value of from 4.0 to 2.5 at 20° C, and a boiling point, at normal pressure, which exceeds 175° C, and finally steaming the material with neutral steam or drying it rapidly.

As coupling components to be used for this process, preferably low-substantivity or medium-substantivity aryl amides, especially phenyl amides or biphenyl diamides which may be substituted, of acetoacetic acid, of 2-hydroxy naphthalene-3-carboxylic acid or of heterocyclic o-hydroxy-carboxylic acid may be mentioned, for example 5-chloro-2-acetoacetylamino-1,4-diethoxy benzene, 4,4'-bis(acetoacetylamino)-3,3'-dimethyl diphenyl and 2-acetoacetyl-amino-6-ethoxy-benthiazole, as well as 2-hydroxy-naphthalene-3-carboxylic acid phenylamide and their derivatives which carry lower alkyl or lower alkoxy groups (of 1 to 4 carbon atoms) or chlorine atoms in the phenylamide radical, such as 2-hydroxy-naphthalene-3-carboxylic acid-(2'-methylphenyl-1')-amide, 2-hydroxy-naphthalene-3-carboxylic acid-(2'-methoxy-phenyl-1')-amide, 2-hydroxy-naphthalene-3-carboxylic acid-(3'-chloro-5'-methoxy-phenyl-1')-amide, and 2-hydroxy-carbazole-3-carboxylic acid-(4'-chloro-phenyl- 1')-amide.

Preferably used amines are not or only scarcely volatile with steam. This ensures not only a good reproducibility of the prints but also a number of further advantages: There is no need for devices that prevent amine vapor from escaping into the atmosphere during the printing, steaming and drying operations; operations of machinery need not be interrupted to remove condensed amines, and dyestuff classes can be used together with the developing dyes which are fixed by steaming.

These amines may be nitro-anilines which may be substituted, such as 2-nitro-aniline, 3-nitro-aniline, 4-nitro-2-amino-anisole, 5-nitro-2-amino-anisole, 5-nitro-2-amino-toluene or 5-nitro-4-amino-anisole; amino-carboxylic acid amides, especially benzoic acids which may be substituted, such as 5-amino-4-methoxy-benzoic acid amide; amino-sulfonic acid amides, especially benzene sulfonic acids which may be substituted, such as 2-amino-anisole-4-sulfonic acid diethylamide or 2-amino-anisole-4-sulfonic acid n-butylamide; amino-nitriles, especially benzonitriles which may be substituted, such as 1-amino-2,5-dimethoxy-4-benzonitrile; benzoyl phenylene diamines which may be substituted, such as 1-amino-4-benzoyl-amino-2,5-dimethoxybenzene, 1-amino-4-benzoylamino-2,5-diethoxy-benzene or 2-amino-4-methyl-5-benzoylamino-anisole; diamino-diphenyls, which may be substituted, such as o-toluidine or dianisidine, as well as other amines currently used in the ice color technique.

The phrase "which may be substituted" implies substitution by one or more identical or different substituents selected from alkyl or alkoxy of 1 to 4 carbon atoms, chlorine and bromine.

The dispersions of amines required for the new process may be prepared by various methods which are known:

For example, adequate dispersions may be obtained by grinding an amine in an aqueous suspension, advantageously in the presence of a dispersing agent, to avoid formation of agglomerates; the grinding operation may be run in a roller or vibratory mill filled with balls; especially useful are ball mills provided with stirrers and filled with glass beads or natural sand. Fine division using a so-called dissolver often also leads to useful results.

It is also possible to mix with water a solid composition that has been prepared by spray-drying a base dispersion containing a solid dispersing agent or by grinding a mixture of a solid dispersing agent and an amine, for example in a pin mill. Suitable dispersions may also be obtained by blending a solution of an amine and a suitable dispersing agent in a water-soluble solvent with water or the printing paste. If the dispersing agent is liquid and has a sufficiently high dissolving power for the amine, a particular solvent need not be used.

The dispersing agents used may be of anionic or nonionic nature and belong, for example, to the following classes of substances:

Long-chain alkyl sulfonates, alkylaryl sulfonates, aryl sulfonates, lignin sulfonates, sulfonated cresol-formaldehyde resins, condensation products of formaldehyde and naphthalene sulfonic acids, alkanoyl amino-sulfonic acids, alkyl polyglycol ethers, alkylaryl polyglycol ethers, aryl polyglyccol ethers, or acyl polyglycol esters.

The dispersions consist of from about 25 to 60% of base and from about 4 to 15% of the dispersing agent. In addition, they may contain an agent, such as glycol or glycerol, to prevent freezing or drying, or a fungicidal agent, such a pentachlorophenol, to suppress potential formation of mould during a prolonged period of storage.

The so-called average particle size (according to RAMLER-ROSIN; (Chemie Ingenieur Technik 36/1964) 523 et seq.) should be 0.002 mm or less in order to ensure satisfactory prints according to the invention, as far as color intensity (tinctorial strength) and uniformity are concerned.

As printing thickeners, any thickener which is resistant to alkali and of low solids content may be used, for example locust bean flour ether thickeners.

The printing pastes may also contain conventional printing aids, such as glycerol, diglycol or dihydroxydiethyl sulfide.

If the dyestuff is to be developed by acidic steaming, the prints that have been dried in a drying chamber or box are developed in a steamer by means of steam containing acid agents, preferably formic acid or a mixture of formic acid/acetic acid, preferably by means of superheated steam, at a temperature of from about 130° to 150° C; adequate passage times for the development of the dyes ranging from 5 to 20 seconds.

If the dyestuff is to be developed by applying an acid solution, all the organic monohydroxy monocarboxylic acids, dihydroxy dicarboxylic acid, monohydroxy tricarboxylic acids or halocarboxylic acids which have a water-solubility of at least 30 g in 100 g of water, a pK value of from 4.0 to 2.5 at 20° C and, at normal pressure, a boiling point of more than 175° C are suitable, for example lactic acid, glycolic acid, tartaric acid, citric acid or monochloroacetic acid.

These acids are transferred onto the preliminary printed and dried textile material in an amount of from 50 g/l to 300 g/l of water, preferably 100 g to 200 g/l of water, by padding, slop-padding, spraying or cross-printing with the help of an entirely engraved stipping roller or a full-printing screen.

Diazotization and coupling which yield the final dyestuff set in spontaneously and almost at the same time, so that — in the simplest case — a continuous air passage of from 40 to 90 seconds is sufficient to complete the development of the dye. The development of the dyestuff can be substantially accelerated by using heat, for example by treating the print with hot air at 130° – 160° C during 20 to 60 seconds in a heating chamber, or by neutral steaming with saturated or superheated steam during 10 to 20 seconds at 100° – 150° C.

If the dyestuff is to be developed by means of solutions of organic solvents, the printing pastes may contain, in addition to the components for the developing dyes, also soluble leuco sulfuric acid ester vat dyes which permit a further increase in the coloration possibilities. In the so-called Africa print, this possibility opens up completely new prospects since, for example with an addition of Sol. Vat Blue 1, C.I. No. 73002, it is possible in a simple manner to produce a strikingly resembling imitation of indigo which is preferably used for the Africa printing and in the batik industry.

A particular advantage of the new process is the possibility of using two different coupling components or amines, thus presenting interesting coloring effects.

The following Examples illustrate the invention, the parts and percentages being by weight unless stated otherwise. The dyes used in the Examples have been taken from the third edition (1971) of the Colour Index.

EXAMPLE 1

15 Parts of 2-hydroxy-naphthalene-3-carboxylic acid-(2'-methyl-phenyl-1')-amide (C.I. No. 37 520) were mixed while stirring with a mixture of 25 parts of ethanol, 30 parts of β,β'-dihydroxy-diethyl-sulfide and 20 parts of 33% sodium hydroxide solution, and the mixture was dissolved by adding 100 parts of water of 60° C. Then, 20 parts of a 40% aqueous dispersion of 4,4'-diamino-3,3'-dimethoxy-diphenyl (C.I. No. 37 235), containing 15% of a lignin sulfonate as a dispersing agent, were diluted with 80 parts of water. With 400 parts of a 5% aqueous thickener of a locust bean flour ether, diluted with 250 parts of water, first the naphthol solution, then the dilute amine dispersion and finally a solution of 20 parts of sodium nitrite in 40 parts of water were stirred. With this printing paste, a bleached and mercerized cotton fabric was printed on a roller printing machine. After having been dried in a drying chamber, it passed through a steamer, in which it was exposed for 20 seconds to superheated steam of 130° C, which contained formic and acetic acids. It was then rinsed as usual with cold and hot water, washed in hot water, rinsed again with hot and cold water and finally dried. A dark blue print was obtained that showed the fastness properties usual for a combination of C.I. No. 37 520/C.I. No. 37 235.

EXAMPLE 2

15 Parts of 2-hydroxy-naphthalene-3-carboxylic acid-(5'-chloro-2,4'-dimethoxy-phenyl-1')-amide (C.I. No. 37 550) were mixed while stirring with a mixture of 40 parts of ethanol, 30 parts of β,β'-dihydroxy diethyl sulfide and 13 parts of 33% sodium hydroxide solution, and the mixture was dissolved by adding 50 parts of water of 70° C. Then, 20 parts of a 40% aqueous dispersion of 5-amino-4-methoxy-benzoic acid amide, containing 12.5% of glycol and, as a dispersing agent, 10% of castor oil fatty acid polyglycol ether were diluted with 80 parts of water.

With 400 parts of a 6% aqueous thickener of a locust bean flour ether, diluted with 300 parts of water, first the naphthol solution, then the dilute amine dispersion and finally a solution of 20 parts of sodium nitrite in 40 parts of water were stirred. Printing and development of the dye were as in Example 1. A red print of outstanding clearness and very good fastness properties was obtained.

EXAMPLE 3

When, in Example 2, 2-hydroxy-naphthalene-3-carboxylic acid-(5'-chloro-2',4'-dimethoxy-phenyl-1')-amide was replaced by 2-hydroxy-naphthalene-3-carboxylic acid-(2'-methoxy-phenyl-1')-amide (C.I. No. 37 530), a red print having an outstanding clearness and good fastness properties was obtained.

EXAMPLE 4

A solution of 20 parts of 5-chloro-2-acetoacetylamino-1,4-dimethoxy-benzene (C.I. No. 37 613) in 32 parts of ethanol, 40 parts of water and 20 parts of 33% sodium hydroxide solution was mixed while stirring with 400 parts of an 8% aqueous thickener of a nonionic locust bean flour ether and 300 parts of water. Then, 20 parts of a 45% dispersion of 4-nitro-2-amino-anisole (C.I. No. 37 130) in water/ethylene glycol with 10% of the polyglycol ether specified below as the dispersing agent, diluted with 100 parts of water, were added, and completed with a solution of 20 parts of sodium nitrite in 30 parts of water. With this printing paste, a bleached and mercerized cotton fabric was printed on a screen printing machine. After having been dried in a drying box attached to the printing machine, the fabric was passed through a steamer, in which it was exposed for 10 seconds to superheated steam of 130° C containing formic and acetic acids. It was then rinsed as usual, soaped, again rinsed and dried. A yellow print having the fastness properties usual for a combination of C.I. No. 37 613/C.I. No. 37 130 was obtained.

The dispersing agent used corresponds to the formula

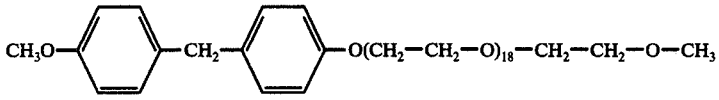

EXAMPLE 5

Following the procedure of Example 4 but replacing the dispersion of 4-nitro-2-amino-anisole by a 45% dispersion of 4-nitro-2-amino-toluene (C.I. No. 37 105) with 14% of a lignin sulfonate as the dispersing agent, a print was obtained having a slightly more greenish shade than in Example 4 but the fastness properties usual for a combination of C.I. No. 37 613/C.I. No. 37 105.

EXAMPLE 6

Following the procedure of Example 4 but replacing the dispersion of 4 -nitro-2-amino-anisole by an otherwise equal dispersion of 4-amino-2,5-dimethoxy-benzonitrile (C.I. No. 37 170), a print was obtained having a slightly more reddish yellow shade than in Example 4 but the fastness properties usual for a combination of C.I. No. 37 613/C.I. No. 37 130.

EXAMPLE 7

Following the procedure of Example 4 but replacing the dispersion of 4 -nitro-2-amino-anisole by an otherwise equal dispersion of 5-nitro-2-amino -anisole (C.I. No. 37 125), a print was obtained having a golden yellow shade and the fastness properties usual for a combination of C.I. No. 37 613/C.I. No. 37 125.

EXAMPLE 8

20 Parts of 2-hydroxy-naphthalene-3-carboxylic acid-(2'-ethoxy-phenyl-1')-amide (C.I. No. 37 558) were dissolved in a mixture of 16 parts of ethanol, 30 parts of $\beta,\beta'$-dihydroxy-diethyl sulfide, 16 parts of 33% sodium hydroxide solution and 40 parts of water of 40° C, and the solution was diluted with 200 parts of water. With 400 parts of an 8% thickener of a nonionic locust bean flour ether, first this naphthol solution, then 20 parts of a dispersion of 4-nitro-2-amino-anisole (composition as in Example 3), which had been diluted with water at a ratio of 1:5, and finally a solution of 20 parts of sodium nitrite in 40 parts of water were blended.

Printing and development of drystuff were as in Example 1. A scarlet print having the fastness properties usual for a combination of C.I. No. 37 558/C.I. No. 37 130 was obtained.

EXAMPLE 9

Following the procedure of Example 8 but replacing the dispersion of 4 -nitro-2-amino-anisole by an otherwise equal dispersion of 4-nitro-2-amino-anisole (C.I. No. 27 125), a red print having the fastness properties usual for a combination of C.I. No. 37 558/C.I. No. 37 125 was obtained.

EXAMPLE 10

15 Parts of 2-hydroxy-naphthalene-3-carboxylic acid-phenyl amide (C.I. No. 37 505), were mixed while stirring with 25 parts of ethanol, 30 parts of $\beta,\beta'$-dihydroxyethyl sulfide and 20 parts of 33% sodium hydroxide solution, and the mixture was dissolved by adding 100 parts of water of 40° C. Then, 30 parts of a 45% dispersion of 4-nitro-2-amino-toluene (C.I. No. 37 130) in water/ethylene glycol (with 14% of a lignin sulfonate as the dispersing agent) were diluted with 100 parts of water.

With 400 parts of a 5% aqueous thickener of locust bean flour ether, first a solution of the coupling component, then the dilute amine dispersion and finally a solution of 20 parts of sodium nitrite in 40 parts of water were blended.

Printing and development of the dyestuff were as in Example 4. A red print having the fastness properties usual for a combination of C.I. No. 37 505/C.I. No. 37 130 was obtained.

EXAMPLE 11

Replacing, in Example 10, 2-hydroxy-naphthalene-3-carboxylic acid phenylamide by 2-hydroxy-carbazole-3-carboxylic acid-(4'-chlorophenyl-1')-amide (C.I. No. 37 600), a brown print was obtained having the fastness properties usual for a combination of C.I. No. 37 600/C.I. No. 37 130.

EXAMPLE 12

Replacing, in Example 9, 2-hydroxy-naphthalene-3-carboxylic acid phenylamide by nickel-phthalocyanine tetra-[sulfonic acid-(3'-<3''-methyl-pyrazolonyl-1''>-phenyl-1')amide], a green print was obtained having good fastness properties.

EXAMPLE 13

15 Parts of 2-hydroxy-naphthalene-3-carboxylic acid-(2'-methyl-phenyl-1')-amide (C.I. No. 37 520) and 5 parts of 4,4'-bis-acetoacetylamide)-3,3'-dimethyl diphenyl (C.I. No. 37 610) were mixed while stirring with 25 parts of ethanol, 30 parts of butyl-diglycol and 23 parts of 33% sodium hydroxide solution, and the mixture was dissolved by adding 100 parts of water of 60° C. This solution was stirred into 400 parts of a 5% aqueous thickener of a locust bean flour ether, and then 30 parts of the dianisidine dispersion described in Example 1 and diluted with 70 parts of water, and a solution of 20 parts of sodium nitrite in 40 parts of water were added. The addition of 250 parts of water ensured the required viscosity.

Printing and development of the dyestuff were as in Example 1. A black print having good fastness properties was obtained.

EXAMPLE 14

20 Parts of 2-hydroxy-naphthalene-3-carboxylic acid-(2'-methyl-phenyl-1')-amide (C.I. No. 37 520) were mixed while stirring with a mixture of 25 parts of ethanol, 30 parts of $\beta,\beta'$-dihydroxy diethyl sulfide and 20 parts of 33% sodium hydroxide solution, and the mixture was dissolved by adding 100 parts of water of 60° C. Then, 20 parts of a 40% aqueous dispersion of 4,4'-diamino-3,3'-dimethoxy-diphenyl (C.I. No. 37 235), containing 15% of a lignin sulfonate as the dispersing agent, were diluted with 80 parts of water.

With 400 parts of a 5% aqueous thickener of a locust bean flour ether, diluted with 250 parts of water, first the naphthol solution, then the dilute amine dispersion and finally a solution of 20 parts of sodium nitrite in 40 parts of water were blended. With this printing paste, a bleached and mercerized cotton fabric was printed on a roller printing machine and dried. After this operation, the material was impregnated at a liquor pick-up of 75% (increase in weight of 75%, referred to the dry weight of the fabric) with an aqueous cold 10% solution of monochloroacetic acid on a two-roller-padding mangle immediately prior to steaming, and then treated with neutral saturated steam of 102° C on the steamer for 2 minutes.

Subsequently, it was rinsed as usual with cold and hot water, washed with hot water, rinsed clear with hot and cold water and finally dried. A print of a full dark blue shade having the fastness properties usual for a combination of C.I. No. 37 520/C.I. No. 37 235 was obtained.

EXAMPLE 15

20 Parts of 2-hydroxy-naphthalene-3-carboxylic acid-(2'-methoxy-phenyl-1')amide (C.I. No. 37 530) were mixed while stirring with a mixture of 40 parts of ethanol, 30 parts of $\beta,\beta'$-dihydroxy diethyl sulfide and 13 parts of 33% sodium hydroxide solution, and the mixture was dissolved by adding 50 parts of water of 70° C. Then, 20 parts of a 40% aqueous dispersion of 5-amino-4-methoxy-benzoic acid amide containing 12.5% of glycol and, as a dispersing agent, 10% of castor oil fatty acid polyglycol ether were diluted with 80 parts of water.

With 400 parts of a 6% aqueous thickener of a locust bean flour ether, diluted with 300 parts of water, first the naphthol solution, then the dilute amine dispersion and finally a solution of 20 parts of sodium nitrite in40 parts of water were blended. With this printing paste, a bleached and mercerized cotton fabric was printed in a desired design on a screen printing machine.

After having been dried, the material was impregnated with a cold aqueous 20% solution of monochloroacetic acid (liquor pick-up 80%) on a nipper, and the dyestuff was continuously developed during an immeditely following air passage of 80 seconds. After the usual aftertreatment, a print was obtained having a bright red shade with the known good fastness properties.

EXAMPLE 16

A solution of 20 parts of 5-chloro-2-acetoacetylamino-1,4-dimethoxy-benzene (C.I. No. 37 613) in 32 parts of ethanol, 40 parts of water and 20 parts of 33% sodium hydroxide solution was mixed while stirring with 400 parts of an 8% aqueous thickener of a nonionic locust bean flour ether and 300 parts of water. Then, 20 parts of a 45% dispersion of 4-nitro-2-amino-toluene (C.I. No. 37 105) in water/ethylene glycol with 14% of a lignin sulfonate as the dispersing agent, diluted with 100 parts of water, were added, and the mixture was blended with a solution of 20 parts of sodium nitrite in 30 parts of water.

With this printing paste, a bleached and causticized spun rayon fabric was printed on a rotary screen printing machine on a round screen with the desired engravings, and after drying it was cross-printed again by means of a full-printing screen with a slightly thickened aqueous 25% solution of tartaric acid, and finally dried directly for 60 seconds with hot air of 130° C in a drier following the printing operation.

Then, it was rinsed as usual, soaped, rinsed again and dried. A yellow print having the fastness properties usual for a combination of C.I. No. 37 613/C.I. No. 37 130 was obtained.

EXAMPLE 17

A solution of 20 parts of 5-chloro-2-acetoacetylamino-1,4-dimethoxy-benzene (C.I. No. 37 613) in 32 parts of ethanol, 40 parts of water and 20 parts of 33% sodium hydroxide solution was mixed while stirring with 400 parts of a 5% aqueous thickener of a locust bean flour ether and 300 parts of water. Then, 20 parts of a 45% dispersion of 5 nitro-2-amino-anisole (C.I. No. 37 125) in water/ethylene glycol with 10% of the polyglycol ether defined in Example 4 as a dispersing agent, diluted with 100 parts of water, were added, and the mixture was blended with a solution of 20 parts of sodium nitrite in 30 parts of water.

With this printing paste, a bleached and mercerized cotton fabric was printed on a screen printing machine. After having been dried in a drying box following the printing machine the fabric was sprayed with a cold aqueous 30% solution of monochloroacetic acid on an electrostatic spraying device preceding the steamer, until a liquor-pickup of 20% had been reached, and then treated immediately in the steamer for 20 seconds with superheated steam of 150° C. After the usual rinsing and soaping operations, a print having a golden yellow shade and the fastness usual for a combination of C.I. No. 37 613/C.I. No. 37 125 was obtained.

EXAMPLE 18

20 Parts of 2-hydroxy-naphthalene-3-carboxylic acid-(2'-ethoxy-phenyl-1')-amide (C.I. No. 37 558) were dissolved in a mixture of 16 parts of ethanol, 30 parts of β,β'-dihydroxy diethyl sulfide, 16 parts of 33% sodium hydroxide solution and 40 parts of water of 40° C, and the solution was diluted with 200 parts of water. With 400 parts of an 8% thickener of a nonionic locust bean flour ether, first this naphthol solution, then 20 parts of a dispersion of 4-nitro-2-amino-anisole (composition as in Example 15), which had been diluted with water at a ratio of 1:5, and finally a solution of 20 parts of sodium nitrite in 40 parts of water were blended.

With this printing paste, a bleached and causticized cotton poplin fabric was printed on the usual roller printing machine, and dried. The dried material was again passed through the same printing machine and cross-printed with a slightly thickened aqueous 25% solution of lactic acid/glycolic acid (1:1) by means of a stripping roller, and then directly dried in a drier following the printing machine, by treating it with hot air of 130° C during 90 seconds. The aftertreatment corresponded to that of Example 14. A scarlet print having the fastness properties usual for a combination of C.I. No. 37 558/C.I. No. 37 130 was obtained.

EXAMPLE 19

15 Parts of 2-hydroxy-carbazole-3-carboxylic acid-(4'-chloro-phenyl-1')-amide (C.I. No. 37 600) were mixed while stirring with 25 parts of ethanol, 30 parts of β,β'-dihydroxy ethyl sulfide and 20 parts of 33% sodium hydroxide solution, and the mixture was dissolved by adding 100 parts of water of 40° C. Then, 30 parts of a 45% dispersion of 4-nitro-2-amino-toluene (C.I. No. 37 130) in water/ethylene glycol (with 14% of a lignin sulfonate as the dispersing agent) were diluted with 100 parts of water. With 400 parts of a 5% aqueous thickener of a locust bean flour ether, first the solution of the coupling component, then the dilute amine dispersion and finally a solution of 20 parts of sodium nitrite in 40 parts of water were blended.

This printing paste was applied by means of a usual flat-printing screen onto bleached and mercerized cotton twills. After having been dried, the material was slop-padded with a cold aqueous solution of 150 g/l of monochloroacetic acid on a padding machine preceding the usual two-phase steamer and steamed with superheated steam of 130° C for 30 seconds.

After the usual aftertreatment, a brown print having the fastness properties usual for a combination of C.I. No. 37 600/C.I. No. 37 130 was obtained.

EXAMPLE 20

20 Parts of nickel phthalocyanine tetra-[sulfonic acid-(3'-<3''-methyl-pyrazolonyl-1''>-phenyl-1')-amide] were mixed while stirring with 25 parts of ethanol, 30 parts of β,β'-dihydroxy ethyl sulfide and 20 parts of 33% sodium hydroxide solution, and the mixture was dissolved by adding 100 parts of water of 40° C. Then, 30 parts of a 45% dispersion of 4-nitro-2-amino-toluene (C.I. No. 37 130) in water/ethylene glycol (with 14% of a lignin sulfonate as the dispersing agent) were diluted with 100 parts of water. With 400 parts of a 5% thickener of a locust bean flour ether, first the solution of the coupling component, then the dilute amine dispersion and finally a solution of 20 parts of sodium nitrite in 40 parts of water were blended.

With this printing paste, bleached and mercerized cotton twills were printed true to pattern on a usual printing device, and dried. After the material had been sprayed with a cold aqueous solution of 300 g/l of monochloroacetic acid on an electrostatic spraying device preceding the steamer, until a liquor pick-up of 20% was reached, the material was at once steamed in a steamer for 20 seconds with superheated steam of 150° C.

After the usual rinsing and soaping operations, a green print having good general fastness properties was obtained.

EXAMPLE 21

A mixture of 15 parts of 2-hydroxy-naphthalene-3-carboxylic acid naphthylamide (C.I. No. 37 600) and 5 parts of 5-chloro-2-acetoacetylamino-1,4-dimethoxy-benzene (C.I. No. 37 613) was mixed while stirring with 25 parts of ethanol, 30 parts of butyl diglycol and 23 parts of 33% sodium hydroxide solution, and the mixture was dissolved by adding 100 parts of water of 60° C. This solution was blended while stirring with 400 parts of a 5% aqueous thickener of a locust bean flour ether, and then 20 parts of the dianisidine dispersion described in Example 14 and diluted with 70 parts of water, and a solution of 20 parts of sodium nitrite in 40 parts of wter were added. By adding 250 parts of water, the required viscosity was reached.

With this printing paste, a bleached cotton tricot fabric was printed on a flat printing machine and dried. Then the printed and dried material was slop-padded with a 20% aqueous solution of monochloroacetic acid on a two-roller padder and immediately dried in a hotflue by means of hot air of 140° C during 80 seconds. After the usual rinsing and soaping operations, a print having a full black shade of high fastness to light and the usual general fastness properties was obtained.

EXAMPLE 22

25 Parts of Sol. Vat Green 1, C.I. No. 59 826, were dissolved while adding 25 parts of butyl diglycol and 25 parts of urea by pouring 150 parts of hot water over them, and the solution was blended while stirring with 400 parts of an 8% aqueous thickener of a nonionic locust bean flour ether and 220 parts of water. Then, a solution of 10 parts of 5-chloro-2-acetoacetylamino-1,4-dimethoxy benzene (C.I. No. 37 613) in 15 parts of ethanol, 20 parts of water and 20 parts of 33% sodium hydroxide solution were added while stirring. Another 10 parts of a 45% dispersion of 4-nitro-2-amino-toluene (C.I. No. 37 105) in water/ethylene glycol with 14% of a lignin sulfonate as the dispersing agent, diluted with 100 parts of water, were also added, and the mixture was blended with a solution of 30 parts of sodium nitrite in 50 parts of water.

With the printing paste thus prepared, a bleached and mercerized cotton fabric was printed true to pattern on a usual printing device, and dried. The material thus printed and dried was then impregnated with a 25% aqueous solution of monochloroacetic acid (liquor pick-up 70%) in the nip of a four-bowl padder and immediately treated for 20 seconds with super-heated steam of 150° C. After the usual aftertreatment, a print having a bright faintly green shade of excellent general fastness properties was obtained.

We claim:

1. A process for printing cellulosic textile material with a printing paste containing a. the alkaline solution of a coupling component capable of forming developing dyes, b. the dispersion of a diazotble amine capable of forming developing dyes, said amine having an average particle size of 0.002 mm or less, c. sodium nitrite and d. a thickener, which process comprises printing said textile material with said printing paste, drying said printed material, developing the dyestuff on the fiber either by acidic steaming or by adding a dilute aqueous solution of an organic acid of which at least 30 g are soluble in 100 g water, having at 20° C a pK value of 4 to 2.5 and at normal pressure a boiling point above 175° C, and steaming said material with neutral steam or immediately drying it.

2. A process as claimed in claim 1, wherein the cellulosic material consists predominantly or entirely of cellulose fibers.

3. A process as claimed in claim 1, wherein the acidic steaming is performed with superheated steam of 130° to 150° C.

4. A process as claimed in claim 1, wherein the acidic steaming is performed with steam containing formic acid or a mixture of formic and acetic acids.

5. A process as claimed in claim 1, wherein the development of the dye is performed with the organic acid solution and the printing paste contains additionally a soluble leuko sulfuric acid ester vat dye.

6. A process as claimed in claim 1, wherein the coupling component has a low or medium substantivity.

7. A process as claimed in claim 6, wherein the coupling component is an arylamide of acetoacetic acid, 2-hydroxy-3-naphthoic acid or of a heterocyclic orthohydroxy carboxylic acid.

8. A process as claimed in claim 1, wherein the amine is not or only scarcely volatile with steam.

9. A process as claimed in claim 8, wherein the amine is a nitroaniline, an anthranilic acid amide, an aniline sulfonic acid amide, an aminobenzonitrile, a benzoyl phenylene diamine or a diamino-biphenyl.

10. A process as claimed in claim 1, wherein the organic acid is a monohydroxy monocarboxylic acid, a dihydroxy dicarboxylic acid, a monohydroxy tricarboxylic acid or a haloalkanoic acid each having up to 3 carbon atoms in their skeleton to which the carboxy groups are bound.

* * * * *